US005211530A

United States Patent [19]

Shiffler

[11] Patent Number: 5,211,530

[45] Date of Patent: May 18, 1993

[54] VARIABLE BREADTH IMPELLER THAT PROVIDES A SPECIFIC SHUTOFF HEAD

[75] Inventor: Mark E. Shiffler, Annapolis, Md.

[73] Assignee: The United States of America as represented by the Secretary of the Navy, Washington, D.C.

[21] Appl. No.: 870,870

[22] Filed: Apr. 20, 1992

[51] Int. Cl.[5] ..... F04D 15/00; F04D 29/28

[52] U.S. Cl. ..... 415/48; 415/131; 415/156; 415/157; 29/889.22; 29/889.7

[58] Field of Search ..... 415/11, 21, 26, 48, 415/49, 131, 140, 141, 155, 156, 157; 29/888.021, 888.024, 889.22, 889.7, 890.141

[56] References Cited

U.S. PATENT DOCUMENTS 2,927,536 3/1960 Rhoades .
2,957,424 10/1960 Brundage et al. ..... 415/48
3,482,523 12/1969 Morando .
3,746,467 7/1973 Buse .
3,918,831 11/1975 Grennan .
4,070,132 1/1978 Lynch .
4,417,849 11/1983 Morris .
4,828,454 5/1989 Morris et al. .

*Primary Examiner*—Edward K. Look
*Assistant Examiner*—Christopher Verdier
*Attorney, Agent, or Firm*—Gary G. Borda

[57] ABSTRACT

In accordance with the present invention, an improved variable breadth impeller for use in a variable capacity centrifugal pump and a method for adapting a variable capacity centrifugal pump to produce a specific predetermined shutoff head are provided. The variable breadth impeller is a two piece unit comprising an impeller element having a plurality of radially extending impeller vanes thereon and an axially movable shroud having a plurality of radially extending grooves therein for receiving the impeller vanes in a meshing relationship. The movable shroud further includes a plurality of axially extending grooves in its outer peripheral surface which act as a supplemental pumping means between minimum flow rate condition and shutoff condition. The operation of the improved variable breadth impeller results in a specific predetermined pressure head being attained and maintained at pump shutoff operating condition.

8 Claims, 5 Drawing Sheets

VARIABLE BREADTH IMPELLER THAT PROVIDES A SPECIFIC SHUTOFF HEAD

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to variable breadth centrifugal pumps (also referred to as variable capacity centrifugal pumps) and, more particularly, to providing an improved shrouded impeller constructed and arranged to provide a specific pressure head at pump shutoff operating condition.

2. Brief Description of Related Art

Standard (fixed geometry) centrifugal pumps are designed to operate at peak efficiency at a specific pressure head and flow rate. In a standard centrifugal pump, such as for example, a Navy Standard Fire Pump, the volume of water within the pump flow passages, i.e., the fluid passages between adjacent impeller vanes, is fixed by the area defined by adjacent impeller vanes, the impeller wall, and the opposing wall of the pump casing. At a constant drive shaft speed (constant impeller speed), as the demand on a standard centrifugal pump decreases the flow rate decreases causing a corresponding increase in the pressure head. In certain pump applications, drive shaft speed, and thus impeller speed, may be varied to account for reduced loads. However, pump efficiency decreases with decreasing impeller speed.

Firemain systems aboard surface ships often include multiple centrifugal pumps connected in parallel, with one or more of the pumps run continually to maintain a specific system pressure and to ensure quick response in the event of an emergency. A typical Navy ship firemain system includes six Navy Standard Fire Pumps, standard centrifugal pumps each capable of producing a constant flow rate of 1000 gallons per minute at a pressure of 150 pounds per square inch. The continuous demand on the firemain system, however, is generally for a flow rate much lower than the design flow rate of the individual pumps. Firemain loads can be less than 25 percent of the design flow rate of the individual pumps, resulting in firemain pressures that are much greater than the design pressures of the pumps.

Increasing firemain system pressure reduces pump efficiency and reliability. Increased pumping pressure results in higher water velocities which, in turn, may produce leaks, increase system noise, and cause corrosion and erosion damage to connected equipment. On naval vehicles powered by gas turbine engines, varying pump shaft speed is not an option. Consequently, centrifugal pumps used on such naval vehicles are run at a constant impeller speed. When pump demand drops below the pump's design flow rate, the result is pressures that are much greater than the design pressures of the pumps. Thus, a need exists for centrifugal pumps which are capable of varying flow rates at a constant pressure and constant impeller speed. Such variable capacity pumps may, therefore, be employed in multiple centrifugal pump systems to efficiently and quietly vary flow and pressure characteristics to match varying system demands.

Variable capacity centrifugal pumps (VCCP) have been designed by the U.S. Navy for use as the firemain system's lead pump maintaining constant system pressure. Variable capacity centrifugal pumps are described, for example, by U.S. Pat. Nos. 4,828,454 and 4,417,849, both assigned to the U.S. Navy. A typical approach for providing a centrifugal pump with variable capacity is to vary the width of the impeller flow passages by incorporating axially adjustable impeller sections.

In U.S. Pat. No. 4,417,849, the variable capacity centrifugal pump arrangement includes two intermeshing impeller sections mounted to a common pump shaft such that one of the impeller sections is axially movable relative to the other impeller section. By axially adjusting the relative position of the impeller sections, the width of the impeller flow passage is varied to increase or decrease flow rate in response to system requirements. U.S. Pat. No. 4,828,454 describes a variable capacity centrifugal pump wherein the flow rate (capacity) is controlled by a shroud movably attached to the impeller drive shaft. The axially movable shroud has grooves for receiving individual impeller vanes. By axially adjusting the the relative position of the impeller and shroud, the width of the impeller flow passage is varied to increase or decrease flow rate in response to system requirements.

During the low demand periods typical for Navy firemain systems, only the variable capacity centrifugal pump (VCCP) is needed to satisfy demand. The VCCP maintains a system pressure of 150 pounds per square inch over a flow range of approximately 250 to 1000 gallons per minute. During intermittent operations requiring additional capacity, such as during deck wash down, pumping of bilges, or in emergency situations, one or more of the stock centrifugal pumps is brought on line to satisfy the increased demand. During periods of increased demand, the stock pumps operate at their design point (1000 gallons per minute at a head of 150 pounds per square inch for Navy Standard Fire Pumps) with the VCCP adjusting its flow rate to provide the balance of the flow demanded while maintaining a head of 150 pounds per square inch. When the increased demand subsides (e.g., dick wash down hoses are turned off), the flow rate will decrease and, ideally, the stock pump(s) will be taken off line and the VCCP will adjust its flow rate to satisfy the reduced demand.

However, it is often the case that, as demand subsides, the stock pump continues to operate resulting in increased system pressure. As long as the VCCP can adjust its flow characteristics to match the increased system pressure, the VCCP and the stock pump share the load. As required flow rate decreases, pump head increases, until a maximum head is reached at shutoff, i.e., zero flow for a standard centrifugal pump. If the VCCP has a lower value of shutoff head than the stock pump then at some point along the head-capacity curve the head of the VCCP will fall below the head of the stock pump. At this point, the stock pump will begin to provide all the flow demanded by the system. As the VCCP continues to operate, undue heating of the fluid within the VCCP will occur ultimately resulting in failure of the VCCP. Thus, in multiple pump systems, there exists a need for a VCCP capable of being adapted to a specific shutoff head that matches the shutoff head of the stock pumps in the system.

The pumps disclosed in U.S. Pat. Nos. 4,828,454 and 4,417,849 were intended to meet operational requirements for Navy variable capacity centrifugal pumps. The pumps were designed to provide constant discharge pressure over a wide operating range, typically on the order of 250 to 1000 gallons per minute. However, an additional requirement for Navy variable capacity centrifugal pumps includes a constantly rising head-capacity curve such that the shutoff head of the variable capacity centrifugal pump matches the shutoff head of a Navy Stock Fire Pump. Present variable capacity centrifugal pump designs do not provide the capability of adapting to and matching the shutoff head of a specific stock pump and, therefore, do not meet the full operational requirements for Navy

SUMMARY OF THE INVENTION

In accordance with the present invention, an improved variable breadth impeller unit for use in a variable capacity centrifugal pump and a method for adapting a variable capacity centrifugal pump to produce a specific predetermined shutoff head are provided. The variable breadth impeller of the present invention is a two piece unit comprising an impeller element having a plurality of radially extending impeller vanes thereon and an axially movable shroud having a plurality of radially extending grooves therein for receiving the impeller vanes in a meshing relationship. The movable shroud further includes a plurality of axially extending grooves in its outer peripheral surface which act as a supplemental pumping means between minimum flow rate condition and shutoff condition. The operation of the improved variable breadth impeller results in a specific predetermined pressure head being attained and maintained at pump shutoff operating condition.

More specifically the variable breadth impeller unit of the present invention comprises an impeller element adapted to be rotationally mounted within a variable capacity centrifugal pump, the impeller element having a plurality of radially extending impeller vanes projecting axially therefrom and defining flow passages therebetween, and a substantially solid annular movable shroud adapted to be rotationally mounted coaxially with said impeller element. The movable shroud is adapted for continuous axial movement between a fully open position defining a constant pressure maximum flow rate operating condition and a fully closed position defining a constant pressure minimum flow rate operating condition whereby the volume of said flow passages is varied. The movable shroud has first and second surfaces disposed axially from one another in a plane substantially orthogonal to the axis of rotation of said impeller element. The first surface of the movable shroud has a plurality of grooves formed therein for receiving the vanes of the impeller element in a meshing relationship. The movable shroud further includes a third surface orthogonally disposed between said first and second surfaces and defining the outer radial perimeter of the movable shroud. The outer peripheral third surface of the movable shroud has a plurality of recessed grooves formed therein extending axially over a portion of the third surface between the first and second surfaces. The recessed grooves act as a supplemental pumping means for energizing the fluid within the variable capacity centrifugal pump during operation between the constant pressure minimum flow rate condition and the shutoff condition of the variable capacity centrifugal pump whereby below a specific flow rate a constantly rising head-capacity curve and a specific shutoff head are achieved.

The method for adapting a variable capacity centrifugal pump to produce a specific predetermined shutoff head comprises the steps of: rotatably mounting an impeller element within a variable capacity centrifugal pump, said impeller element having a plurality of radially extending impeller vanes projecting axially therefrom and defining flow passages therebetween; rotatably mounting a substantially solid annular movable shroud in coaxial alignment with said impeller element, said movable shroud having at least three surfaces including first and second surfaces disposed axially from one another in a plane substantially orthogonal to the axis of rotation of said impeller element and a third surface orthogonally disposed between said first and second surfaces and defining an outer radial perimeter of said movable shroud; providing said first surface of said movable shroud with a plurality of grooves formed for receiving said vanes of said impeller element in a meshing relationship; adapting said movable shroud for continuous axial movement between a fully open position defining a constant pressure maximum flow rate operating condition and a fully closed position defining a constant presure minimum flow rate operating condition whereby the volume of said flow passages is varied; and providing said third surface of said movable shroud with a plurality of recessed grooves extending axially over a portion of said third surface between said first and second surfaces wherein said recessed grooves act as a supplemental pumping means for increasing the fluid pressure head within the variable capacity centrifugal pump during operation between the constant pressure minimum flow rate condition and the shutoff condition of the variable capacity centrifugal pump whereby below a specific flow rate a constantly rising head-capacity curve and a specific shutoff head are achieved.

OBJECTS OF THE INVENTION

Accordingly, it is an object of the present invention to provide an improved variable breadth impeller for a variable capacity centrifugal pump that is easily adaptable to and capable of matching the shutoff head of an adjoining stock pump.

It is a further object of the present invention to provide a variable breadth impeller for a variable capacity centrifugal pump that will meet the full operational requirements of a Navy variable capacity centrifugal pump It is still a further object of the present invention to provide a variable breadth impeller for a variable capacity centrifugal pump that is relatively inexpensive to manufacture and is inherently reliable due to simplicity of design.

Other objects and advantages of the present invention will become apparent to those skilled in the art upon a reading of the following detailed description taken in conjunction with the drawings and the claims supported thereby.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding elements throughout and wherein.

DETAILED DESCRIPTION OF THE PREFERRED EMBODIMENT

Figure 1:
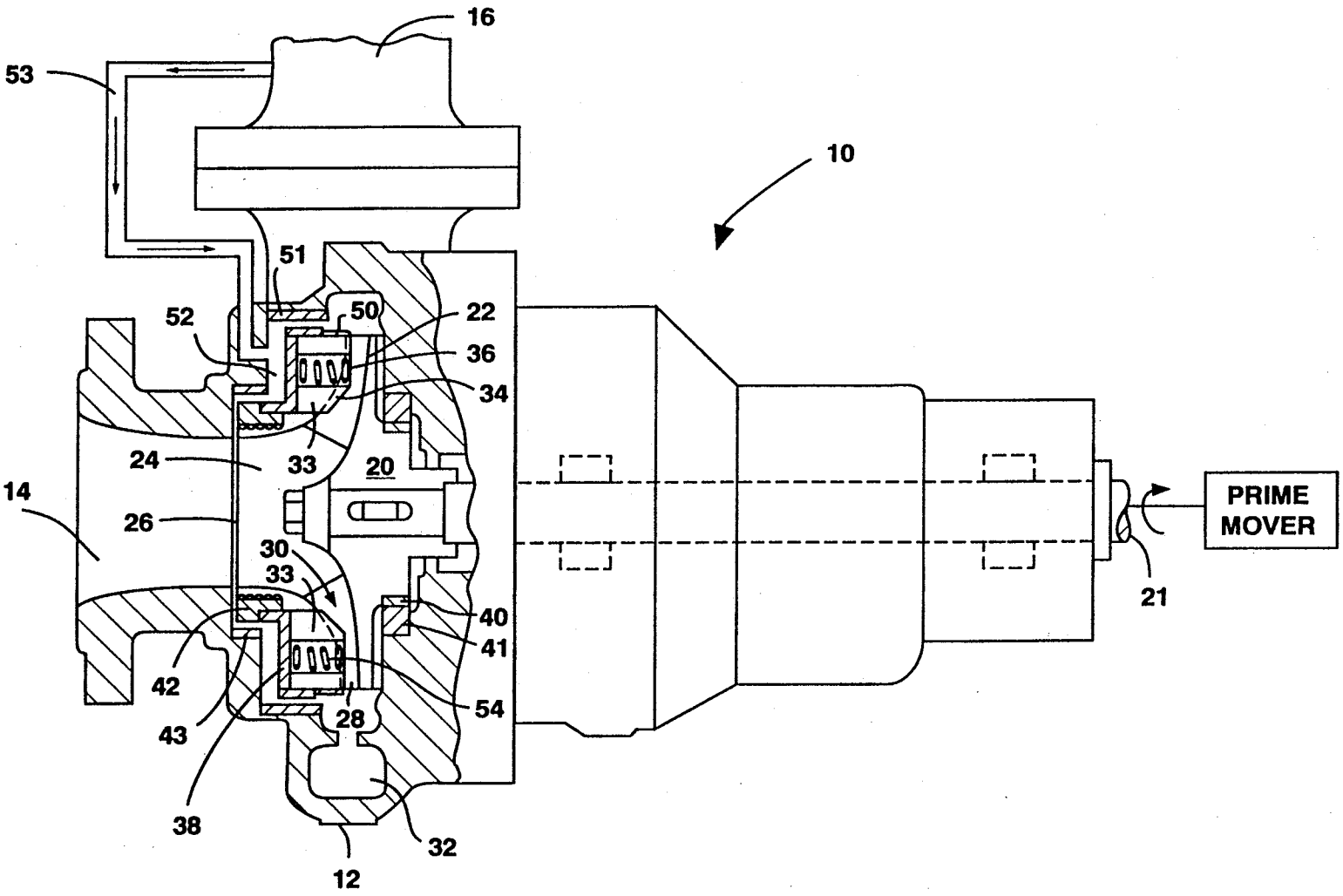
FIG. 1. is a plan view, partially in section, of a typical centrifugal pump including the variable breadth impeller of the present invention at constant pressure maximum flow condition.

Referring now to FIGS. 1 through 4, any typical variable capacity centrifugal pump, generally shown as item 10, may incorporate the variable breadth impeller unit in accordance with the present invention. A typical variable capacity pump includes pump casing 12 with casing axial inlet 14 and casing radial outlet 16. Rotating impeller element 20, mounted, by conventional means, to rotating pump drive shaft 21, has a plurality of impeller vanes 22 projecting axially therefrom. Pump shaft 21 may be journalled in bearings and caused to be rotated by a prime mover such as, for example, an electric motor or, in the case of a typical naval vehicle, a gas turbine. Impeller element 20 may be of a hollow conical shape with impeller axial inlet 24 at its forward extending portion 26 and impeller radial outlet 28 at its outer radially extending portions. Axial inlet 24 and radial outlet 28 are internally connected by a plurality of impeller vanes 22. Impeller flow passages 30, located between adjacent impeller vanes 22, provide flow passage means for channelling fluid entering impeller element 20 through axial inlet 24 and exiting impeller element 20 through radial outlet 28.

During the operation of a standard centrifugal pump, fluid is introduced into the casing axial inlet 14, is channeled through impeller axial inlet 24 and along impeller flow passages 30 by the action of rotating impeller element 20, is output through impeller radial outlet 28 into casing 12 which defines the radial output surrounding the tips of impeller vanes 22, and is collected, at an operating pressure, in toroidal collector 32. A standard centrifugal pump is designed to operate at peak efficiency at a specific head and flow rate.

In a standard centrifugal pump, such as for example, a Navy Standard Fire Pump, the width of flow passages 30 are fixed by the distance between impeller element 20 and the opposing wall of casing 12. At a constant pump shaft/impeller speed, as the demand on the pump decreases, the flow rate decreases and the head increases correspondingly. In certain pump application shaft speed may be varied to account for reduced load, however, pump efficiency decreases with decreasing impeller speed. On naval vehicles powered by gas turbine engines, varying pump shaft speed is not an option. Thus, centrifugal pumps used on such naval vehicles are run at a constant impeller speed. Consequently, a need exists for a centrifugal pump which is capable of varying flow rates at a constant pressure and constant impeller speed.

In order to convert a standard (fixed geometry) centrifugal pump into a variable capacity centrifugal pump, impeller element 20 is fitted with an axially movable shroud 33. Movable shroud 33 is generally annular shaped and mounted coaxially with impeller element 20 around the forwardly extending portion 26 of impeller element 20. Movable shroud 33 is caused to rotate with pump drive shaft 21 by torque transmitted to movable shroud 33 via impeller element 20. Impeller element 20 and movable shroud 33 are telescopingly related. Movable shroud 33 is a substantially solid ring like member with female grooves 34 on a first surface 36, which faces opposing impeller element 20, for receiving impeller vanes 22 and for forming a fluid tight seal with impeller vanes 22 and impeller flow passages 30 of impeller element 20.

Rear impeller wear ring 40 and rear casing wear ring 41 are disposed about a rearwardly extending portion of impeller element 20, between impeller element 20 and casing 12, in order to seal and maintain fluid discharge pressure in toroidal collector 32. Impeller wear ring 40 is fixedly attached to impeller element 20 and casing wear ring 41 is fixedly attached to casing 12 and coaxial with and surrounding impeller wear ring 40. Alternatively, other standard sealing means may be employed.

Forward impeller wear ring 42 and forward casing wear ring 43 are disposed about forwardly extending portion 26 of impeller element 20, between impeller element 20 and casing 12, in order to seal and maintain fluid back pressure to a second surface 38 of movable shroud 33. Impeller wear ring 42 is fixedly attached to impeller element 20 and casing wear ring 43 is fixedly attached to casing 12 and coaxial with and surrounding impeller wear ring 42. Impeller wear ring 42 is stepped on its outer diameter to slidingly engage movable shroud 33 and is threaded on its inner diameter to threadedly engage threads provided on the outer peripheral surface of the forward extending portion 26 of impeller element 20, thereby forming a shroud retaining means for retaining movable shroud 33 on impeller 20.

Figure 2:
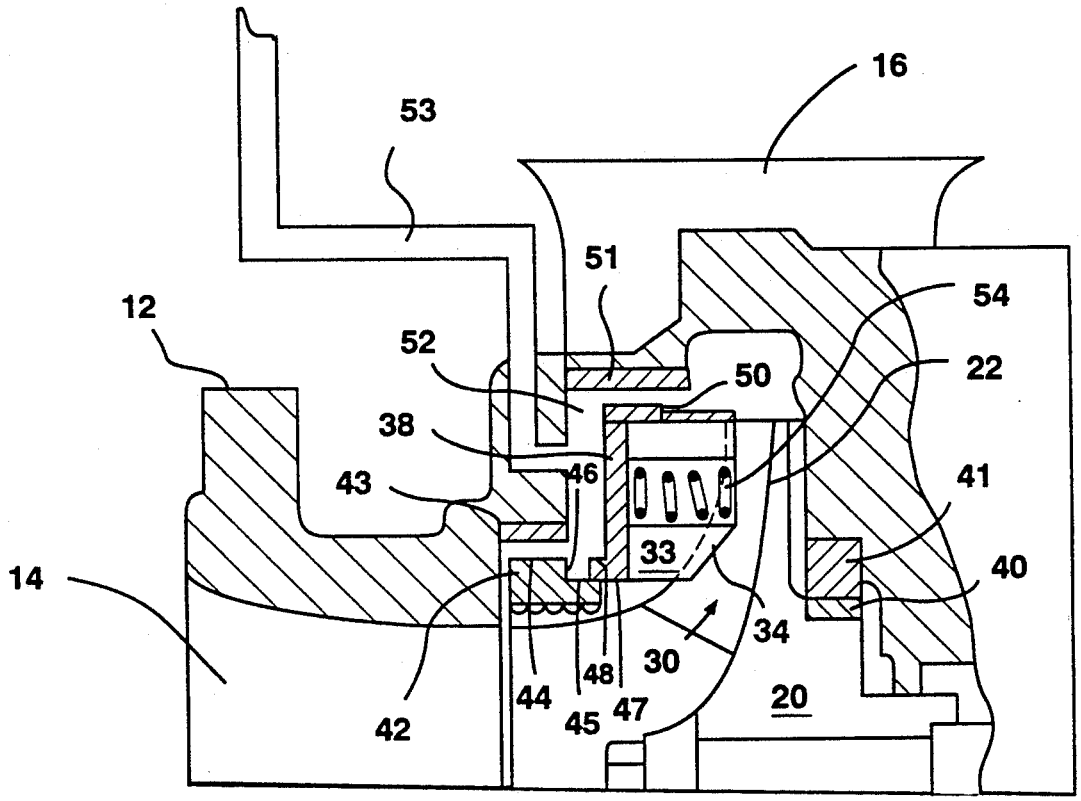
FIG. 2. is an enlarged plan view, partially in section, of a typical centrifugal pump including the variable breadth impeller of the present invention at constant pressure minimum flow condition.

As shown in FIG. 2, impeller wear ring 42 has a first outer diameter 44 and a second outer diameter 45 smaller than first outer diameter 44 thus forming step 46. First outer diameter 44 rotates in a close relationship with casing wear ring 43. Second outer diameter 45 slidingly engages inwardly facing surface 47 of movable shroud 33. Thus, step 46 and second outer diameter 45 of impeller wear ring 42 form a shroud retaining means for retaining movable shroud 33 on impeller element 20.

During operation of variable capacity centrifugal pump 10, the width of flow passages 30, and hence of the flow capacity of the pump, are varied by means of axially movable shroud 33. Axially movable shroud 33 is adapted for continuous axial movement between a fully open position defining a constant pressure maximum flow rate operating condition and a fully closed position defining a constant pressure minimum flow rate operating condition whereby the volume of flow passages 30 is varied. To change the width of impeller flow passages 30, movable shroud 33 moves axially relative to axially fixed impeller element 20. As shown in FIG. 2, movable shroud 33 is inserted to the maximum depth of impeller flow passages 30 for minimum impeller flow passage width (fully closed position). As shown in FIG. 1, for maximum impeller flow passage width, movable shroud 33 is withdrawn axially from impeller flow passages 30 until forwardly extending portion 48 of movable shroud 33 abuts step 46 of impeller wear ring 42 (fully open position).

Movable shroud wear ring 50 and center casing wear ring 51 are disposed about the outer periphery of movable shroud 33, between movable shroud 33 and casing 12, in order to seal and maintain fluid back pressure to second surface 38 of movable shroud 33 thus forming a control cavity 52 between movable shroud wear ring 50 and center casing wear ring 51 and forward impeller wear ring 42 and forward casing wear ring 43. Movable shroud wear ring 50 is fixedly attached to movable shroud 33 and casing wear ring 51 is fixedly attached to casing 12. Casing wear ring 51 is wide enough to remain coaxial with and surround movable shroud 33 for the entire axial travel of movable shroud 33.

In operation, fluid discharged radially outward from impeller flow passages 30, defined by impeller vanes 22 of impeller element 20 and mating movable shroud 33, is received in toroidal collector 32 under fluid discharge pressure. Toroidal collector 32 is in fluid communication with radial outlet 16 under fluid back pressure. Pipe means 53 puts fluid under back pressure within radial outlet 16 in communication with control cavity 52, thereby putting the fluid back pressure in fluid communication with second surface 38 of movable shroud 33. When demand on the pump decreases the fluid back pressure increases and the fluid pressure in control cavity 52 increases forcing movable shroud 33 to close, i.e., move axially toward impeller element 20 thus decreasing the width of impeller flow passages 30. When demand on the pump increases the fluid back pressure decreases and the fluid pressure in control cavity 52 decreases whereby movable shroud 33 opens, i.e., is biased toward a maximum impeller flow passage width, by means of biasing means 54, such as coil springs situated between movable shroud female grooves 34 and impeller vanes 22. Thus, by sensing the back pressure in control cavity 52, movable shroud 33 can be positioned to control the pump flow rate and head.

Figure 5:
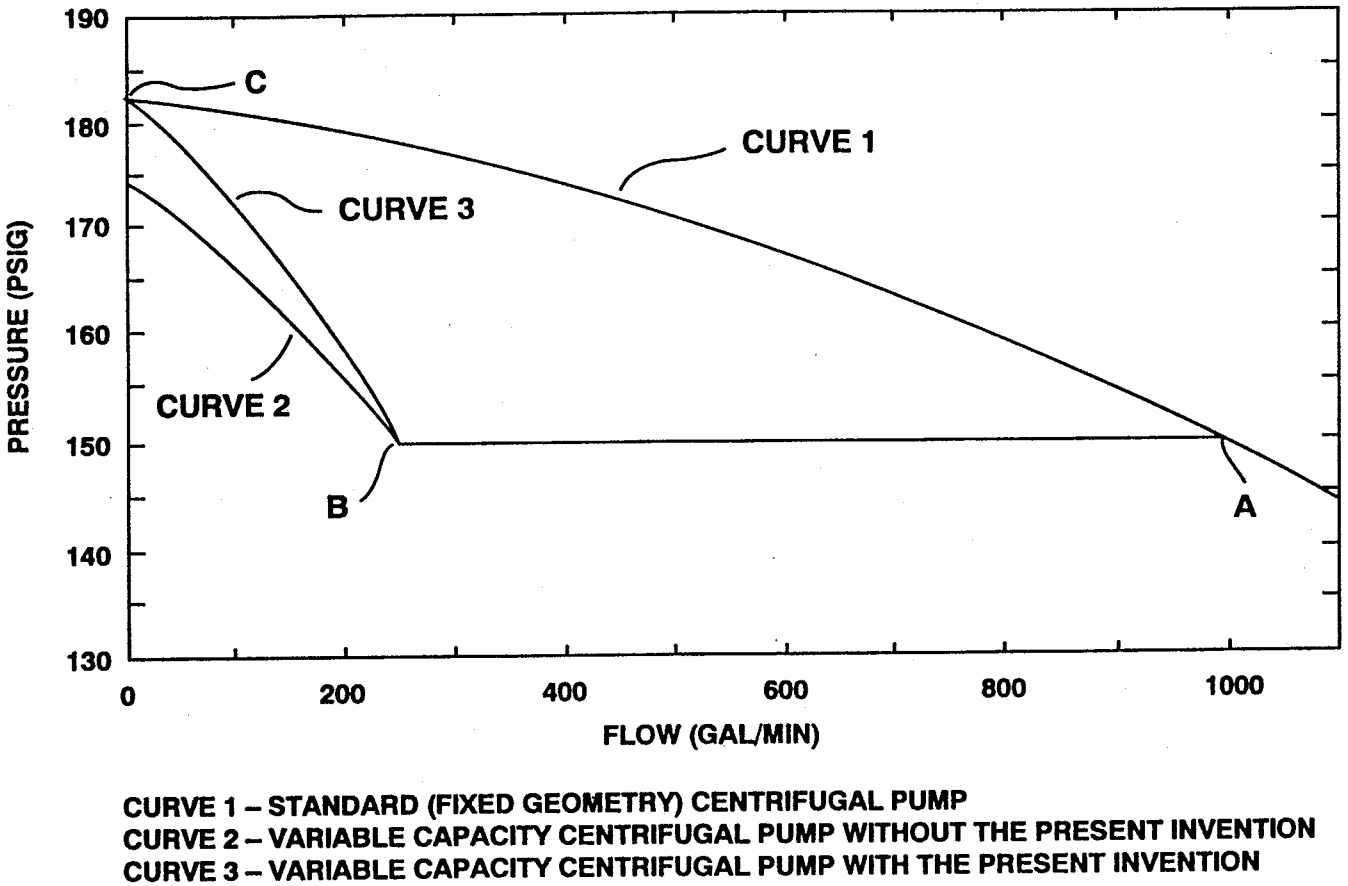
FIG. 5. is a family of curves representative of head-capacity curves for a standard (fixed geometry) centrifugal pump, a variable capacity centrifugal pump without the improved variable breadth impeller of the present invention, and a variable capacity centrifugal pump that includes the improved variable breadth impeller in accordance with the present invention.

When a variable capacity centrifugal pump (VCCP) operates in parallel with one or more standard centrifugal pumps, the pumps must share the load. In order for pumped fluid to flow through all active pumps in the system, the pumps must maintain equal pumping heads. As shown in FIG. 5, a standard centrifugal pump (curve 1) operates along a constantly rising head-capacity curve. A VCCP in accordance with the present invention (curve 3) operates at a constant head over a large flow rate range, e.g., between the constant pressure maximum flow rate condition (point A on curve 3) with shroud 33 fully open and the constant pressure minimum flow rate condition (point B on curve 3) with shroud 33 fully closed. However, below the constant pressure minimum flow rate condition, as demand on the system decrease the VCCP will experience a constantly increasing head (i.e., a constantly rising head-capacity curve) culminating at shutoff condition (point C on curve 3).

As shown in FIG. 5, if the shutoff head of the standard VCCP (curve 2) does not match the shutoff head of the standard (fixed geometry) centrifugal pump (curve 1), there comes a point where the head of the VCCP falls below that of the standard centrifugal pump. At this point, the stock pump provides all the flow demanded by the system. As the VCCP continues to operate, undue heating of the fluid within the VCCP will occur ultimately resulting in failure of the VCCP. Thus, in multiple pump systems, there exists a need for a VCCP capable of being adapted to a specific shutoff head that matches the shutoff head of the stock pumps in the system. The variable breadth impeller and method in accordance with the present invention (curve 3) satisfies such a need.

In accordance with the present invention, movable shroud 33 is provided with a supplemental pumping means for providing a specific predetermined shutoff head during shutoff operating condition of the variable capacity centrifugal pump. The supplemental pumping means is a means for energizing the fluid within the variable capacity centrifugal pump during operation between the constant pressure minimum flow rate condition and the shutoff condition of the variable capacity centrifugal pump (zero flow condition) whereby below a specific flow rate a constantly rising head-capacity curve culminating in a specific shutoff head is achieved. Movable shroud 33 includes third surface 55 orthogonally disposed between first surface 36 and second surfaces 38 and defining an outer radial perimeter of movable shroud 33. A constantly rising head-capacity curve below a specific flow rate culminating in a specific shutoff head is achieved by forming a plurality of recessed grooves 56 in third surface 55 of movable shroud 33. Recessed grooves 56 act as supplemental pumping means for increasing the flow head within the variable capacity centrifugal pump when movable shroud 33 is fully closed. During open shroud operation, however, recessed grooves 56 contribute only marginally to the pump head.

Figure 3:
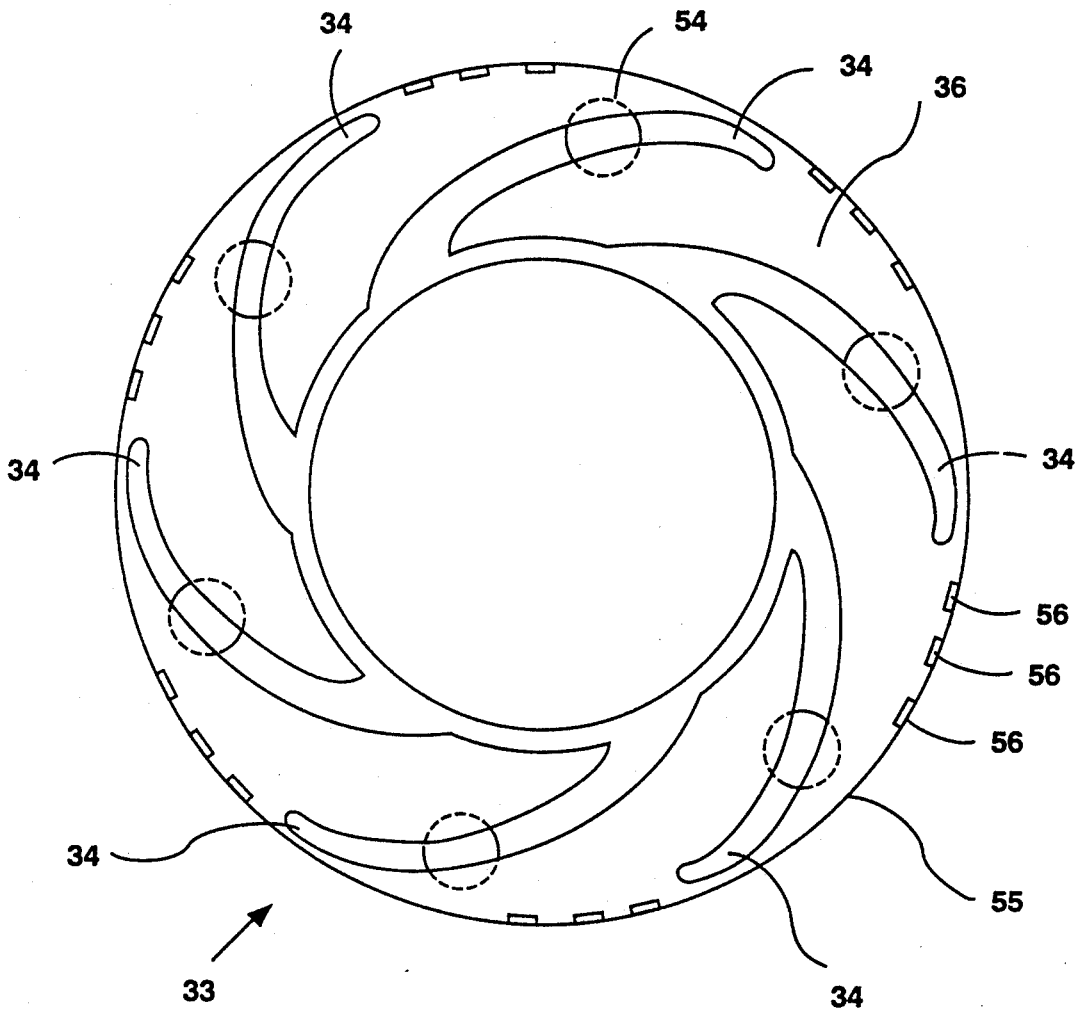
FIG. 3. is a frontal plan view of the shroud in accordance with the present invention.
Figure 4:
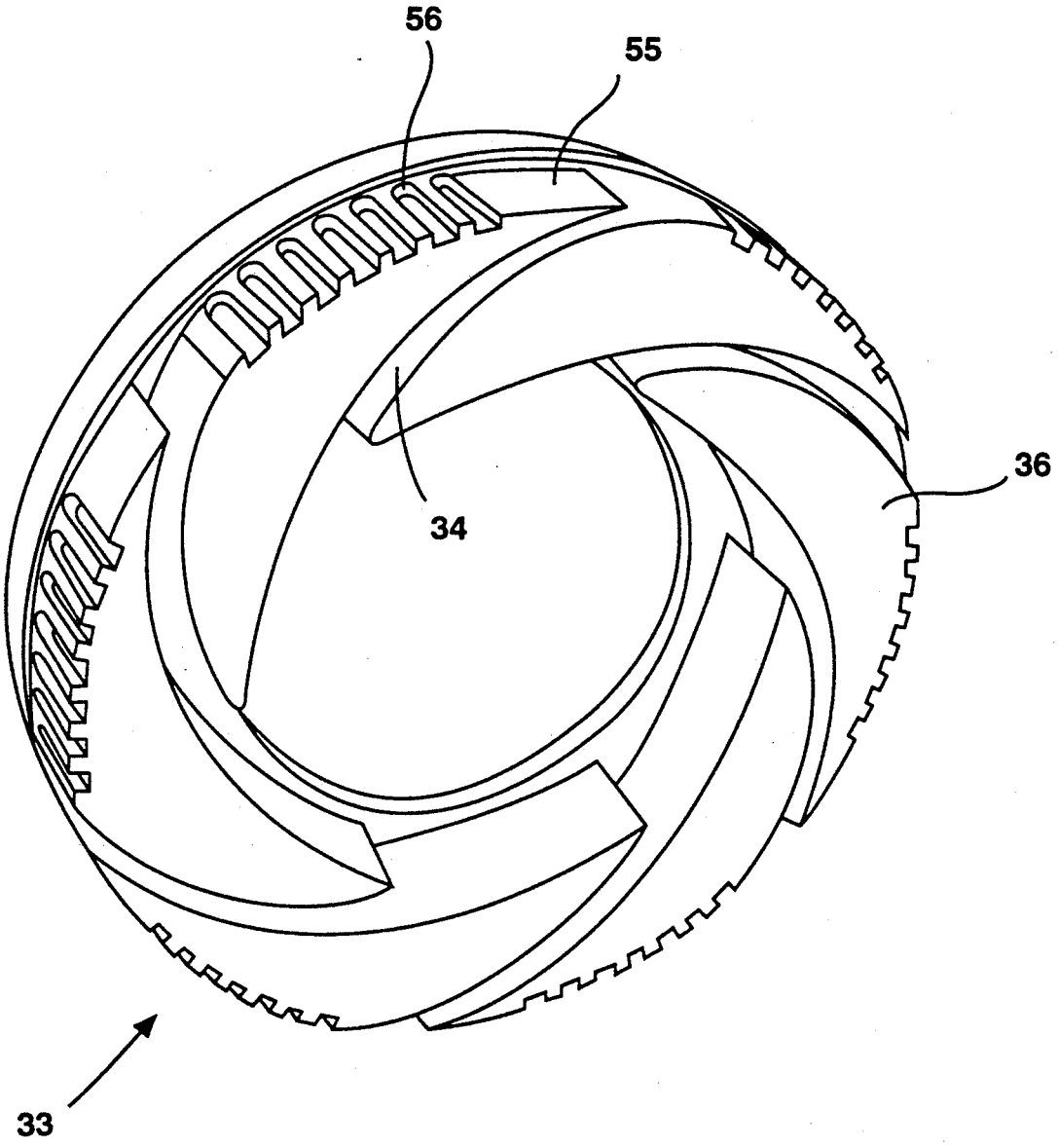
FIG. 4. is a perspective view of an alternative embodiment of the shroud of the present invention.

Recessed grooves 56 extend axially over a portion of third surface 55 between first surface 36 and second surfaces 38. The exact number, shape and location of recessed grooves 56 for a particular pump are fixed, however, the number, shape and location may be tailored to satisfy the specific operating conditions required for a particular pump application. As shown in FIG. 3, female grooves 34 on first surface 36 of the annular shaped movable shroud 33 may extend partially from near the central opening of movable shroud 33, which is adjacent to and coaxial with impeller axial inlet 24, to near the outer periphery of movable shroud 33 such that third surface 55 of movable shroud 33 is a continuous unbroken surface. In such a case, recessed grooves 56 may be located at any point along third surface 56 of movable shroud 33. Alternatively, as shown in FIG. 4, female grooves 34 may extend completely from adjacent axial inlet 24 to the outer periphery of movable shroud 33 such that third surface 55 of movable shroud 33 is a discontinuous surface having gaps at the outer radial ends of female grooves 34 in first surface 36. In such a case, recessed grooves 56 formed in third surface 55 of movable shroud 33 are located between the gaps at the outer radial ends of female grooves 34.

A number of specific embodiments of the present invention have been reduced to practice and applied to a Navy Variable Capacity Centrifugal Pump design. Navy Variable Capacity Centrifugal Pumps designs are intended for use in shipboard firemain systems connected in parallel to multiple Navy Standard Fire Pumps. In such a system, a Navy Variable Capacity Centrifugal Pump will provide a constant system pressure of 150 pounds per square inch over a flow range of approximately 250 to 1000 gallons per minute. Navy Standard Fire Pumps, standard centrifugal pumps capable of producing a constant flow rate of 1000 gallons per minute at a pressure of 150 pounds per square inch, have a shutoff head of 182 pounds per square inch at 1.03 specific gravity. In contrast, as shown in FIG. 5, the shutoff head of a Navy Variable Capacity Centrifugal Pump design at the fully closed position of a variable breadth impeller without recessed perimeter grooves 56 (curve 2 of FIG. 5) is 174 pounds per square inch at 1.03 specific gravity. As shown by curve 3 of FIG. 5, raising the shutoff head of a Navy Variable Capacity Centrifugal Pump design to match that of the Navy Standard Fire Pumps was accomplished by machining six sets of seven recessed grooves 56 around the perimeter (third surface 55) of movable shroud 33. As shown in FIG. 4, recessed grooves 56 were formed in third surface 55 of movable shroud 33 between the gaps at the outer radial ends of female grooves 34.

The advantages of the present invention are numerous.

Any typical variable capacity centrifugal pump may incorporate the variable breadth impeller that provides a specific shutoff head in accordance with the present invention.

In multiple pump systems, there exists a need for a variable capacity centrifugal pump capable of being adapted to a specific shutoff head that matches the shutoff head of the stock pumps in the system. The variable breadth impeller and method in accordance with the present invention satisfies such a need.

Accordingly, the present invention provides an improved variable breadth impeller for a variable capacity centrifugal pump that is easily adaptable to and capable of matching the shutoff head of an adjoining stock pump.

Furthermore, the present invention provides a variable breadth impeller for a variable capacity centrifugal pump that will meet the full operational requirements of a Navy variable capacity centrifugal pump by incorporating a variable breadth impeller that is relatively inexpensive to manufacture and is inherently reliable due to simplicity of design.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. In a variable capacity centrifugal pump having an inlet and an outlet, a variable breadth impeller unit that provides a specific shutoff head comprising:

flow passage means for channeling a flow under pressure from the pump inlet to the pump outlet;

means for varying the rate of flow through said flow passage means between a constant pressure maximum flow rate operating condition and a constant pressure minimum flow rate operating condition; and supplemental pumping means for providing a specific predetermined shutoff head during a shutoff operating condition of the variable capacity centrifugal pump wherein below a specific flow rate a constantly rising head-capacity curve culminating in said specific shutoff head is achieved.

2. A variable breadth impeller unit as in claim 1 wherein said flow passage means comprises:

an impeller element adapted to be rotationally mounted within the variable capacity centrifugal pump, said impeller element having a plurality of radially extending impeller vanes projecting axially therefrom and defining flow passages therebetween, at least one axial inlet in flow communication with the pump inlet and with said flow passages, at least one radial outlet in flow communication with the pump outlet and with said flow passages whereby flow is channeled under the effects of said rotating impeller element from said axial inlet through said flow passages to said radial outlet.

3. A variable breadth impeller unit as in claim 2 wherein said means for varying the rate of flow through said flow passage means comprises:

an annular movable shroud adapted to be rotationally mounted coaxially with said impeller element;

said movable shroud including first and second surfaces disposed axially from one another in a plane substantially orthogonal to the axis of rotation of said impeller element, said first surface having a plurality of grooves formed for receiving said vanes of said impeller element in a meshing relationship; and said movable shroud adapted for continuous axial movement between a fully open position defining the constant pressure maximum flow rate operating condition and a fully closed position defining the constant pressure minimum flow rate operating condition whereby the volume of said flow passage means is varied.

4. A variable breadth impeller unit as in claim 3 wherein said supplemental pumping means comprises:

a plurality of recessed grooves formed in a third surface of said movable shroud, said third surface orthogonally disposed between said first and second surfaces and defining an outer radial perimeter of said movable shroud, said recessed grooves extending axially over a portion of said third surface between said first and second surfaces wherein said recessed grooves act as a supplemental pumping means for energizing the flow within the variable capacity centrifugal pump during operation between the constant pressure minimum flow rate condition and the shutoff condition of the variable capacity centrifugal pump.

5. In a variable capacity centrifugal pump, a variable breadth impeller unit that provides a specific shutoff head comprising:

an impeller element adapted to be rotationally mounted within the variable capacity centrifugal pump, said impeller element having a plurality of radially extending impeller vanes projecting axially therefrom and defining flow passages therebetween, at least one axial inlet in flow communication with said flow passages, at least one radial outlet in flow communication with said flow passages whereby flow is channeled under the effects of said rotating impeller element from said axial inlet through said flow passages to said radial outlet;

a substantially solid annular movable shroud adapted to be rotationally mounted coaxially with said impeller element;

said movable shroud including first and second surfaces disposed axially from one another in a plane substantially orthogonal to the axis of rotation of said impeller element, said first surface having a plurality of grooves formed therein for receiving said vanes of said impeller element in a meshing relationship;

said movable shroud adapted for continuous axial movement between a fully open position defining a constant pressure maximum flow rate operating condition and a fully closed position defining a constant pressure minimum flow rate operating condition whereby the volume of said flow passages is varied; and said movable shroud further including a third surface orthogonally disposed between said first and second surfaces and defining an outer radial perimeter of said movable shroud, said third surface having a plurality of recessed grooves formed therein, said recessed grooves extending axially over a portion of said third surface between said first and second surfaces wherein said recessed grooves act as a supplemental pumping means for energizing the flow within the variable capacity centrifugal pump during operation between the constant pressure minimum flow rate condition and the shutoff condition of the variable capacity centrifugal pump whereby said specific shutoff head is achieved.

6. A variable breadth impeller unit as in claim 5 wherein said grooves in said first surface of said movable shroud extend from adjacent said axial inlet to the outer periphery of said movable shroud such that said third surface of said movable shroud is a discontinuous surface having gaps at the outer radial ends of said grooves in said first surface and further wherein said recessed grooves formed in said third surface of said movable shroud are located between said gaps.

7. A variable breadth impeller unit as in claim 5 further comprising a shroud retaining means attached to said impeller element wherein said movable shroud is maintained in assembled relationship with said impeller element.

8. A method for adapting a variable capacity centrifugal pump to produce a specific predetermined shutoff head comprising the steps of:

rotatably mounting an impeller element within said variable capacity centrifugal pump, said impeller element having a plurality of radially extending impeller vanes projecting axially therefrom and defining flow passages therebetween, at least one axial inlet in flow communication with said flow passages, at least one radial outlet in flow communication with said flow passages wherein a fluid is channeled under the effects of said rotating impeller element from said axial inlet through said flow passages to said radial outlet;

rotatably mounting an annular movable shroud in coaxial alignment with said impeller element, said movable shroud having at least three surfaces including first and second surfaces disposed axially from one another in a plane substantially orthogonal to the axis of rotation of said impeller element and a third surface orthogonally disposed between said first and second surfaces and defining an outer radial perimeter of said movable shroud;

providing said first surface of said movable shroud with a plurality of grooves formed for receiving said vanes of said impeller element in a meshing relationship;

adapting said movable shroud for continuous axial movement between a fully open position defining a constant pressure maximum flow rate operating condition and a fully closed position defining a constant pressure minimum flow rate operating condition whereby the volume of said flow passages is varied; and providing said third surface of said movable shroud with a plurality of recessed grooves extending axially over a portion of said third surface between said first and second surfaces wherein said recessed grooves act as a supplemental pumping means for energizing the fluid within the variable capacity centrifugal pump during operation between the constant pressure minimum flow rate condition and the shutoff condition of the variable capacity centrifugal pump whereby below a specific flow rate a constantly rising head-capacity curve and said specific shutoff head are achieved.

* * * * *